US012479634B2

(12) United States Patent
Dhawan

(10) Patent No.: US 12,479,634 B2
(45) Date of Patent: Nov. 25, 2025

(54) CHILD-RESISTANT CLOSURE WITH TWIN LOCKING

(71) Applicant: SSF PLASTICS INDIA PRIVATE LIMITED, Mumbain (IN)

(72) Inventor: Daksh Dhawan, Mumbai (IN)

(73) Assignee: SSF Plastics India Private Limited, Mumbai (IN)

( * ) Notice: Subject to any disclaimer, the term of this patent is extended or adjusted under 35 U.S.C. 154(b) by 32 days.

(21) Appl. No.: 18/025,211

(22) PCT Filed: Feb. 24, 2022

(86) PCT No.: PCT/IB2022/051640
§ 371 (c)(1),
(2) Date: Mar. 8, 2023

(87) PCT Pub. No.: WO2022/180567
PCT Pub. Date: Sep. 1, 2022

(65) Prior Publication Data

US 2023/0312194 A1 Oct. 5, 2023

(30) Foreign Application Priority Data

Feb. 24, 2021 (IN) ..... 202121007836

(51) Int. Cl.
*B65D 50/04* (2006.01)

(52) U.S. Cl.
CPC ..... *B65D 50/041* (2013.01); *B65D 2215/02* (2013.01)

(58) Field of Classification Search
CPC ..... B65D 50/041; B65D 2215/02
See application file for complete search history.

(56) References Cited

U.S. PATENT DOCUMENTS 3,881,625 A 5/1975 Landen
5,005,718 A * 4/1991 Buono ..... B65D 50/041 215/220

(Continued)

FOREIGN PATENT DOCUMENTS

KR 200445674 Y1 8/2009

OTHER PUBLICATIONS

Search Report dated May 31, 2022, Application No. PCT/IB2022/051640.

*Primary Examiner* — Shawn M Braden
(74) *Attorney, Agent, or Firm* — The Dobrusin Law Firm, P.C.

(57) ABSTRACT

A child resistant closure with twin locking comprising a container including a body portion defining a chamber, and a hollow neck extending from the body portion, an inner cap (2) formed to fit around the hollow neck of the container, an outer cap (1) operably disposed over the inner cap (2) adapted to impart an axial rotational force on the inner cap, plurality of locking ratchet (C) positioned on the circumferential inner sidewall surface (D) of the outer cap (1) and on the circumferential outer sidewall surface (02) of the inner cap (2), plurality of locking teeth (E) positioned on the inner top surface (10) of the outer cap (1) and on the top surface (9) of the inner cap (2) wherein by pressing the outer cap (1) downward on the inner cap (2), the plurality of locking ratchet (C) positioned on the circumferential inner sidewall surface (D) of the outer cap (1) and the plurality of locking ratchets (04) positioned on the circumferential outer sidewall surface (02) of the inner cap (2) gets engaged with each other to impart rotation to the inner cap (2) in anticlockwise direction to remove the closure from the container. Further, it also discloses the use plurality of locking teeth to provide additional force to remove the closure from the container.

5 Claims, 14 Drawing Sheets

(56) References Cited

U.S. PATENT DOCUMENTS

| | | | | |
|---|---|---|---|---|
| 5,147,052 | A * | 9/1992 | Minette | B65D 50/068 215/220 |
| 7,111,746 | B2 | 9/2006 | Miceli et al. | |
| 8,747,634 | B2 * | 6/2014 | Oya | G01N 27/407 73/23.31 |
| 2004/0226907 | A1 * | 11/2004 | Miceli | B65D 41/0471 215/217 |
| 2004/0262251 | A1 * | 12/2004 | Tauber | B65D 50/041 215/220 |

* cited by examiner

CHILD-RESISTANT CLOSURE WITH TWIN LOCKING

TECHNICAL FIELD OF THE INVENTION

The present invention relates to closures for bottles, and more specifically, to child-resistant safety closures with twin locking.

BACKGROUND OF THE INVENTION

Safety closures that prevent children from opening containers are useful for medicine bottles, cleaning supplies containers, or bottles containing other dangerous substances. To reduce the number of accidental incidents, which may result due to access to unsafe medicine by children, containers are properly closed by means of closures. The most important attribute of closures is security as it controls access to the product. Various closures having tamper-proof and child-resistant features are developed to control access to the contents of the container by overcoming accidental incidents and to improve upon existing features of closures.

CA2259436 C discloses a child-resistant closure including a container (16) and a cap (21). The container includes a body portion (11) defining a chamber, and a hollow neck (10) extending from the body portion. The cap is formed to fit around the neck and includes a base portion (20) and a lid portion (30) connected to the base portion with a hinge (60). At least one first engagement portion (42) extends from a lever portion (24) attached to the base portion and is positioned to engage at least one second engagement portion (52) that is integrally formed in the lid portion. The engagement portions are located offset from a location diametrically opposite the hinge. The closure is in a locked position when the first engagement portion engages the second engagement portion. The closure is moved to an unlocked position when the lever portion is pushed inwardly to disengage the first portion from the second portion.

U.S. Pat. No. 7,000,789 B2 discloses a reversible child-resistant closure system including closure and container. The closure has a child-resistant mode when applied to the container in a first child-resistant position and has a non-child resistant mode when applied to the container in a second non-child resistant position. The closure includes an outer cap and an inner cap. The inner cap is coaxially positioned and nested within the outer cap such that a plurality of angular abutment surfaces of the inner cap engages a series of angular abutments of the outer cap upon rotation of the outer cap to rotate the inner cap in a closing direction. However, upon rotation of the outer cap member in an opening direction in the absence of an axial force, the angular abutment surfaces of the inner cap cam over and past the series of angular abutments of the outer cap, preventing rotation of the inner cap.

U.S. Pat. No. 7,111,746 B2 a shellable, positively lockable, child-resistant closure and container that includes a pair of nested inner and outer caps designed to be purposefully shellable for use in its non-child resistant mode. The inner cap is coaxially positioned and nested within the outer cap such that a row of angular abutments of the inner cap engages a row of angular abutments of the outer cap upon rotation of the outer cap in a closing direction, and upon rotation of the outer cap in an opening direction, without a concomitant axial force, the respective angular abutments cam over and past each other to prevent rotation of the inner cap. Additionally, the inner cap contains a positive locking device for engagement with a complementary locking device on the neck of the container.

U.S. Pat. No. 8,474,634 B1 discloses a child-resistant closure having an outer cap and an inner cap each of which has a base wall on a peripheral skirt with sets of lugs on the inner surface of the outer closure member and on the outer surface of the inner closure member which are adapted to be engaged when the members are moved axially toward one another. The outer surface of the inner cap is provided with a plurality of vents to allow for the increased evacuation of fluid between the inner and outer cap.

US20110147334 A1 relates to child-resistant closures, and more particularly to child-resistant closures with multiple caps, engaged by two oppositely acting locking systems, which offer advantages over the prior art by enabling easier opening, yet remains child-resistant. It discloses an inner cap having a dome-shaped top panel having peripheral arches and central ratchets with the inner side consisting of elevated threads and an outer cap having elevated projections complimentary to the projections of top surface of inner cap, so as to match with each other leading to a locking arrangement which allows the inner cap to move by the force applied on the outer cap in clockwise direction, the elevated projections of outer closure rides over the gradational elevations of inner cap causing slippage of the outer closure over the inner closure leading to free movement, wherein the closure does not contain any stop member.

U.S. Pat. No. 7,815,061 B1 discloses a push and turn child resistant closure is provided which includes a combined over cap and under cap, the under cap freely rotational within the over cap and the combined closure installed on the container. For removal of the combined closure, both downward and counter-clockwise rotational force is applied to the over cap, the rotational force imparted on the under cap more readily by utilization of a friction ring at the engagement area between the over cap and the under cap while also having an outer gripping ring of highly frictional material making it much more easily rotatable and graspable by a user. The use of a highly frictional material more readily imparts rotational force on the under cap when utilized as depicted herein.

To be effective, safety closures must be too difficult for children to operate yet easy for adults to manipulate. In addition, safety cap designs must recognize the limitations of the manufacturing process and therefore, the designs should be simple and have few parts in order to be manufactured and assembled easily and economically.

There is a dire need to provide a simple and improved child-resistant closure with twin locking. The above described prior art system suffers from many disadvantages, which the present invention effectively eliminates.

SUMMARY OF THE INVENTION

The following disclosure presents a simplified summary of the invention in order to provide a basic understanding of some aspects of the invention. This summary is not an extensive overview of the present invention. It is not intended to identify the key/critical elements of the invention or to delineate the scope of the invention. Its sole purpose is to present some concept of the invention in a simplified form as a prelude to a more detailed description of the invention presented later.

An objective of the present invention is to overcome the problems of prior art.

An objective of the present invention is to provide a simple and effective child-resistant closure with twin locking.

Yet another objective of the present invention is to provide a child-resistant closure with simple construction and easy assembly on a necked bottle container.

Yet another objective of the present invention is to provide a child-resistant closure suitable for almost all kinds of necked bottle.

One aspect of the present disclosure is to provide a simple and effective child-resistant closure with twin locking. The invention is basically catering safety of a particular age group of children's to deny access to medical or medical or harmful products. It focuses on closures openable or removable by the combination of two actions to be performed simultaneously e.g. in this case pushing and turning. The invention discloses the use of a plurality of locking ratchets in the angled and stepped form in both the upper and inner cap. Further, it also has an additional provision of locking teeth to provide an additional locking feature to the inner and outer cap of the container.

In one implementation of the first aspect as described above, the present invention provides a child resistant closure with twin locking, comprising a container including a body portion defining a chamber, and a hollow neck extending from said body portion, an inner cap formed to fit around the hollow neck of the container, an outer cap operably disposed over the inner cap adapted to impart an axial rotational force on the inner cap, plurality of locking ratchet positioned on the circumferential inner sidewall surface of the outer cap, plurality of locking ratchet positioned on the circumferential outer sidewall surface of the inner cap, plurality of locking teeth positioned on the inner top surface of the outer cap, plurality of locking teeth positioned on the top surface of the inner cap wherein by pressing the outer cap downward on the inner cap, the plurality of locking ratchet positioned on the circumferential inner sidewall surface of the outer cap and the plurality of locking ratchets positioned on the circumferential outer sidewall surface of the inner cap gets engaged with each other to impart rotation to the inner cap in anticlockwise direction to remove the closure from the container and wherein the plurality of locking teeth of the outer cap gets engaged with the plurality of locking teeth of the inner cap maintaining sealing of the outer cap and the inner cap adapted to provide additional force to remove the closure from the container.

In another implementation of the first aspect as described above, the outer cap of the closure comprises a plurality of serration on the circumferential outer sidewall surface of the outer cap adapted to enhance the gripping of a user on the outer cap.

In another implementation of the first aspect as described above, the inner cap comprises a plurality of threads and at least one wad retain ring on the circumferential inner sidewall surface adapted to grip and hold the hollow neck of the container without slipping downwards beyond a predetermined point on the hollow neck of the container.

In another implementation of the first aspect as described above, the locking ratchet positioned on the circumferential inner sidewall surface of the outer cap is complementary to the locking ratchet positioned on the circumferential outer sidewall surface of the inner cap.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF ACCOMPANYING DRAWINGS

The above and other aspects, features and advantages of the embodiments of the present disclosure will be more apparent in the following description taken in conjunction with the accompanying drawings, in which.

Figure 1:
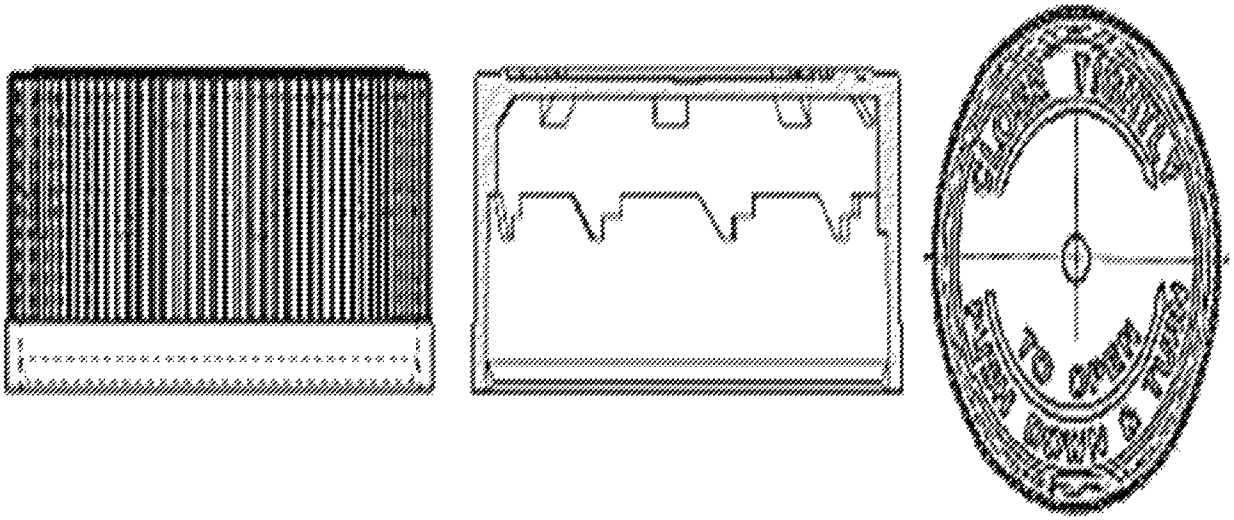
FIG. 1 illustrates schematic front view, sectional view and perspective view of the outer cap of the child-resistant closure with twin locking, according to one of the embodiments of the present invention.
Figure 2:
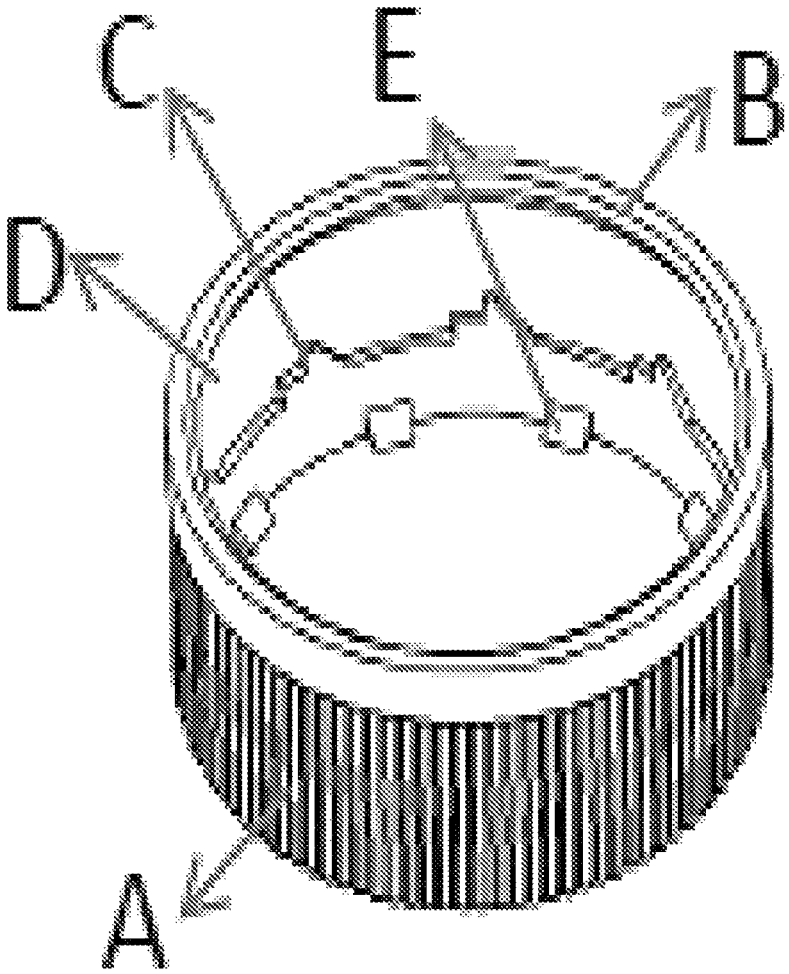
FIG. 2 illustrates the schematic inner and outer view of the outer cap of the child-resistant closure with twin locking, according to one of the embodiments of the present invention.
Figure 3:
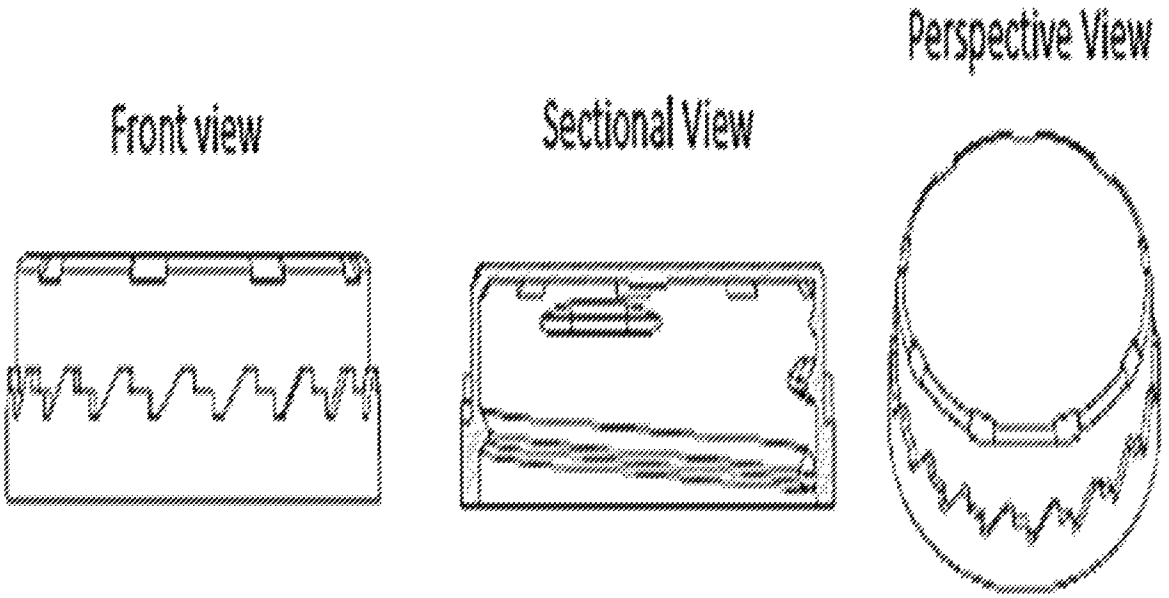
FIG. 3 illustrates schematic front view, sectional view and perspective view of the inner cap of the child-resistant closure with twin locking, according to one of the embodiments of the present invention.
Figure 4:
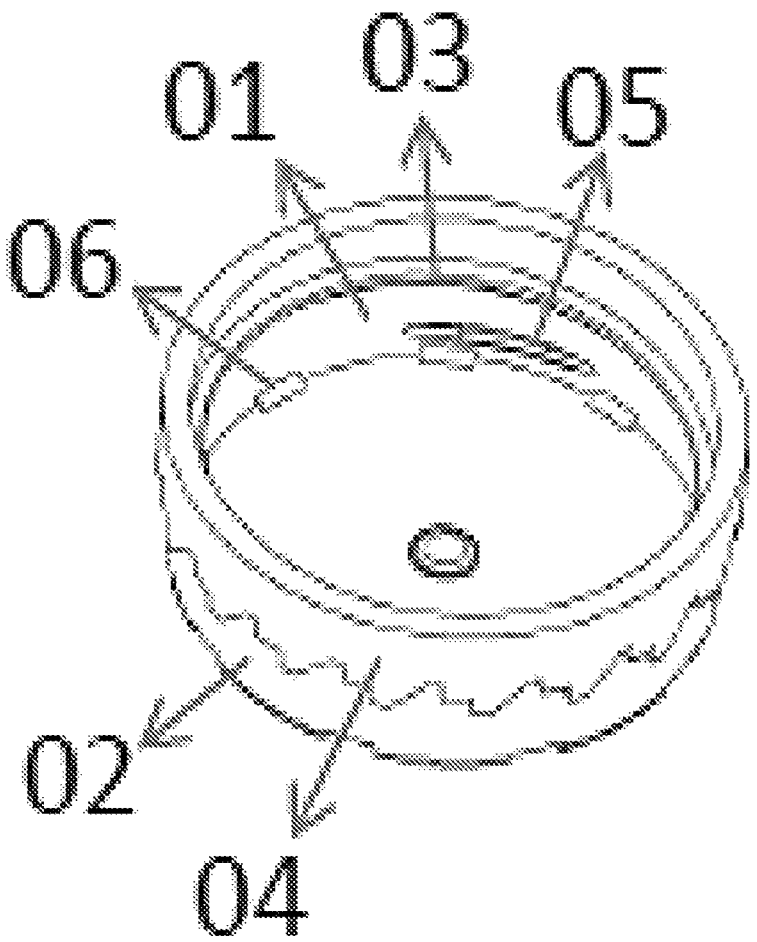
FIG. 4 illustrates the schematic outer and inner view of the inner cap of the child-resistant closure with twin locking, according to one of the embodiments of the present invention.
Figure 5:
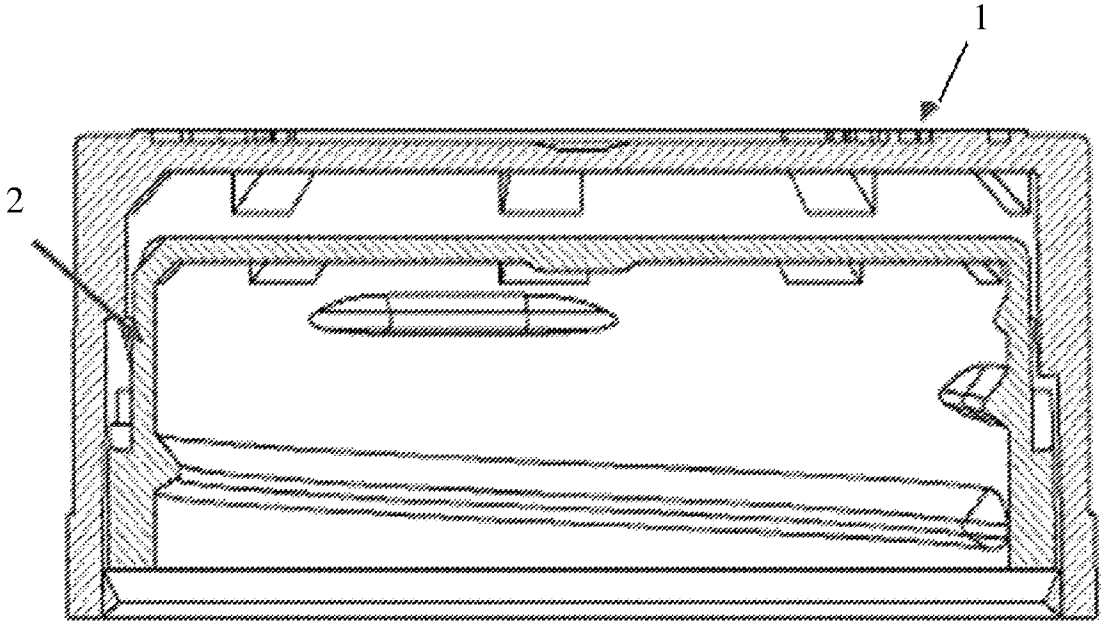
FIG. 5 illustrates schematic view of the outer cap engaged with the inner cap before applying pressure on the outer cap, according to one of the embodiments of the present invention.
Figure 6:
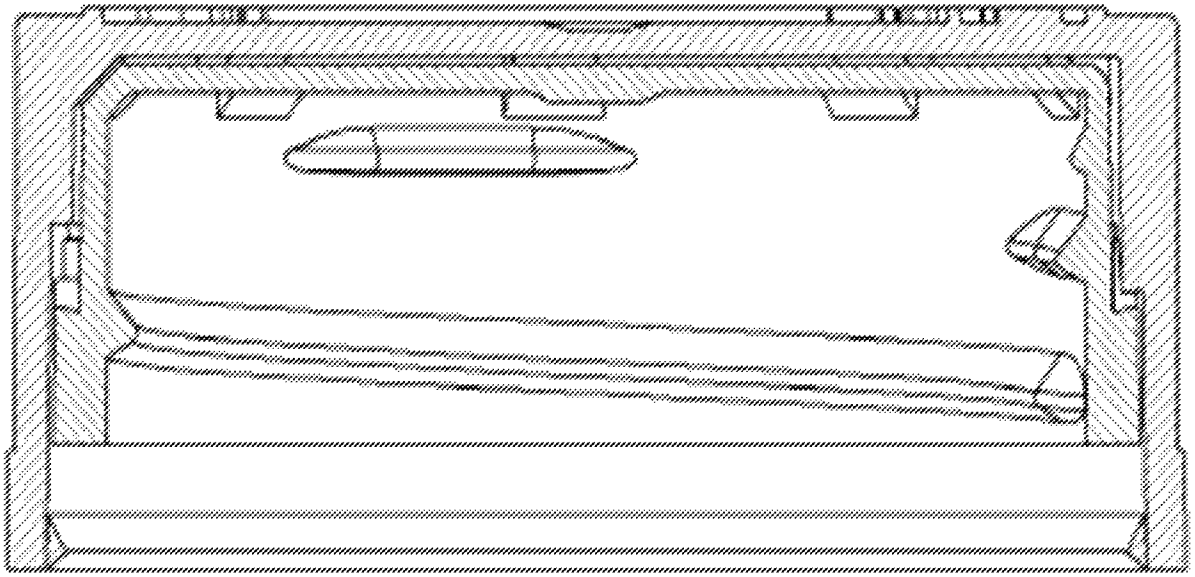
FIG. 6 illustrates schematic view of the outer cap engaged with the inner cap after applying pressure on the outer cap, according to one of the embodiments of the present invention.
Figure 7:
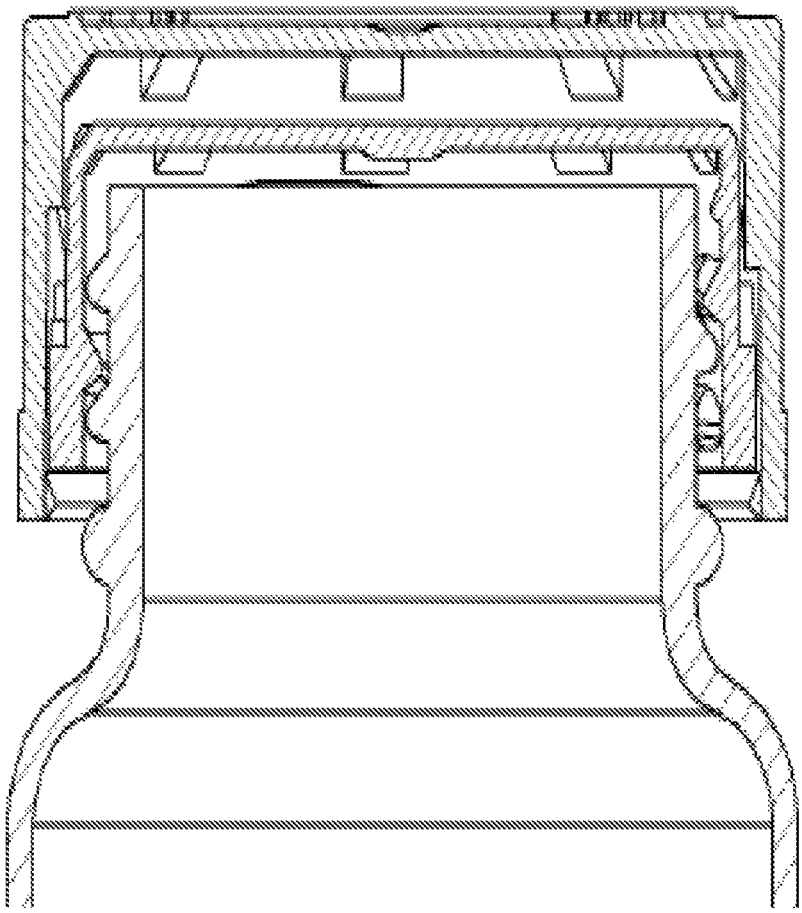
FIG. 7 illustrates schematic view of the cap assembly with the container and outer cap engaged with the inner cap before applying pressure, according to one of the embodiments of the present invention.
Figure 8A:
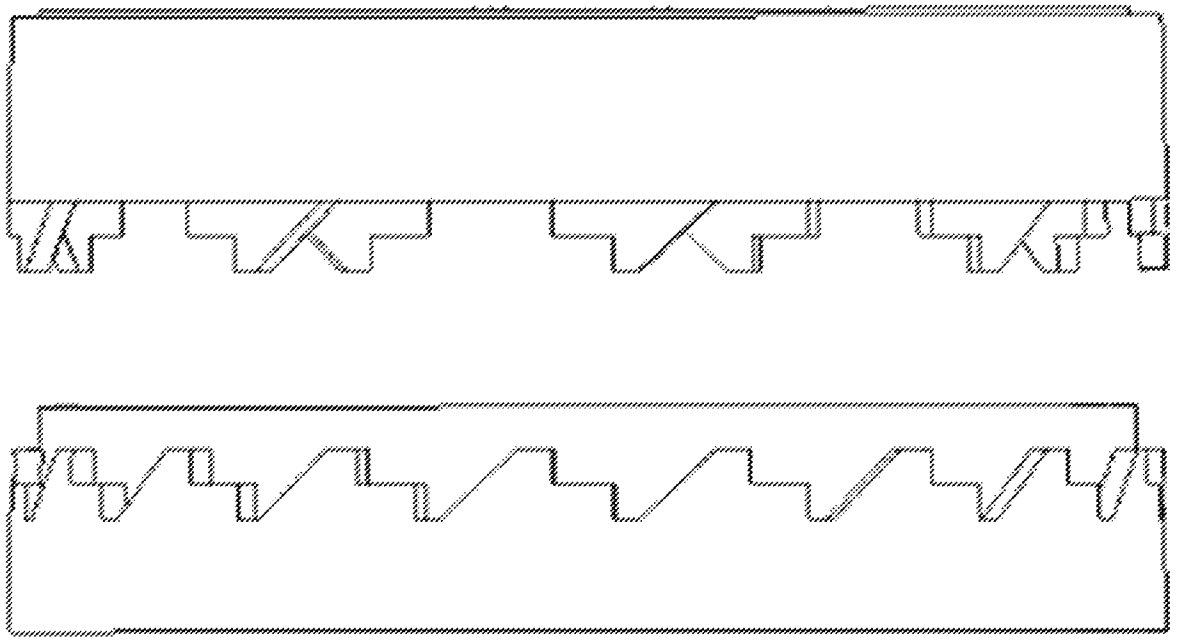
Figure 8B:
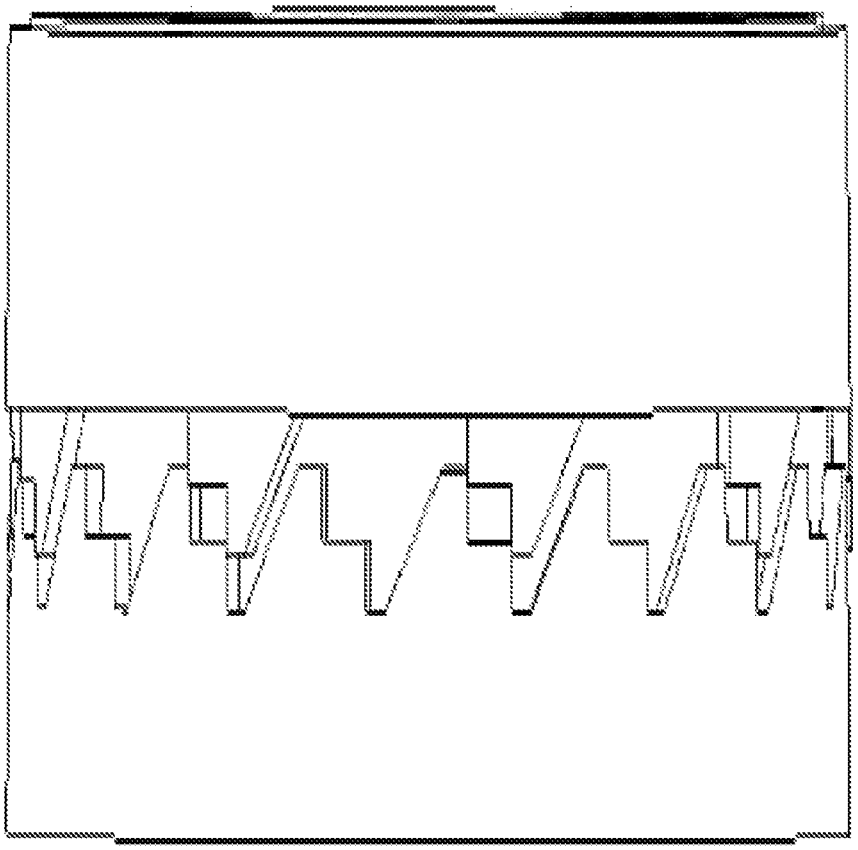
Figure 8C:
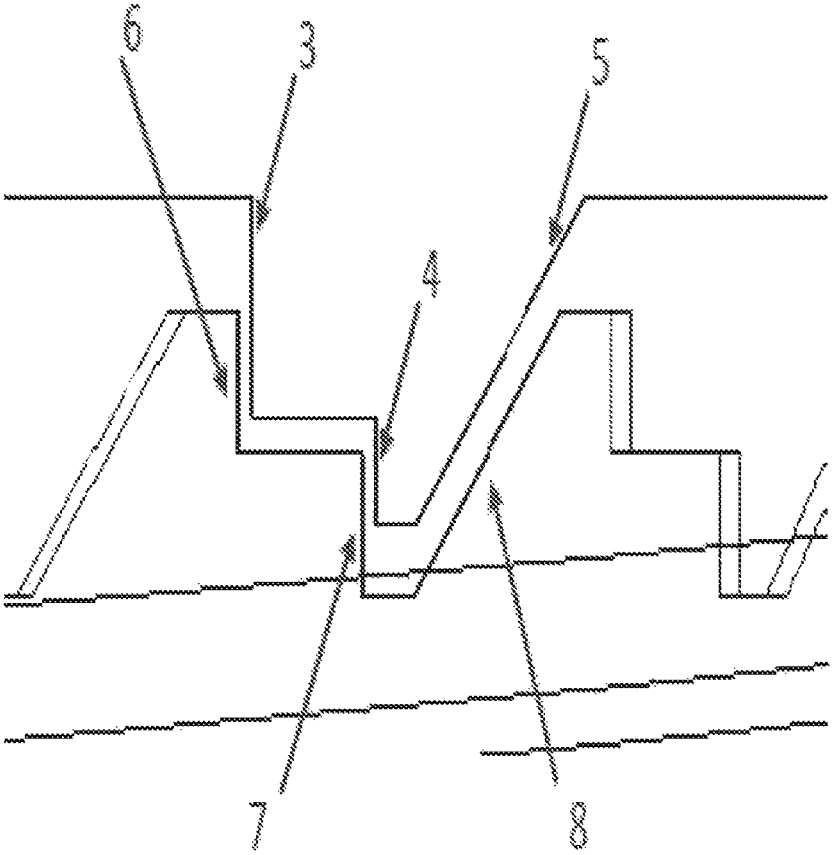
Figure 9A:
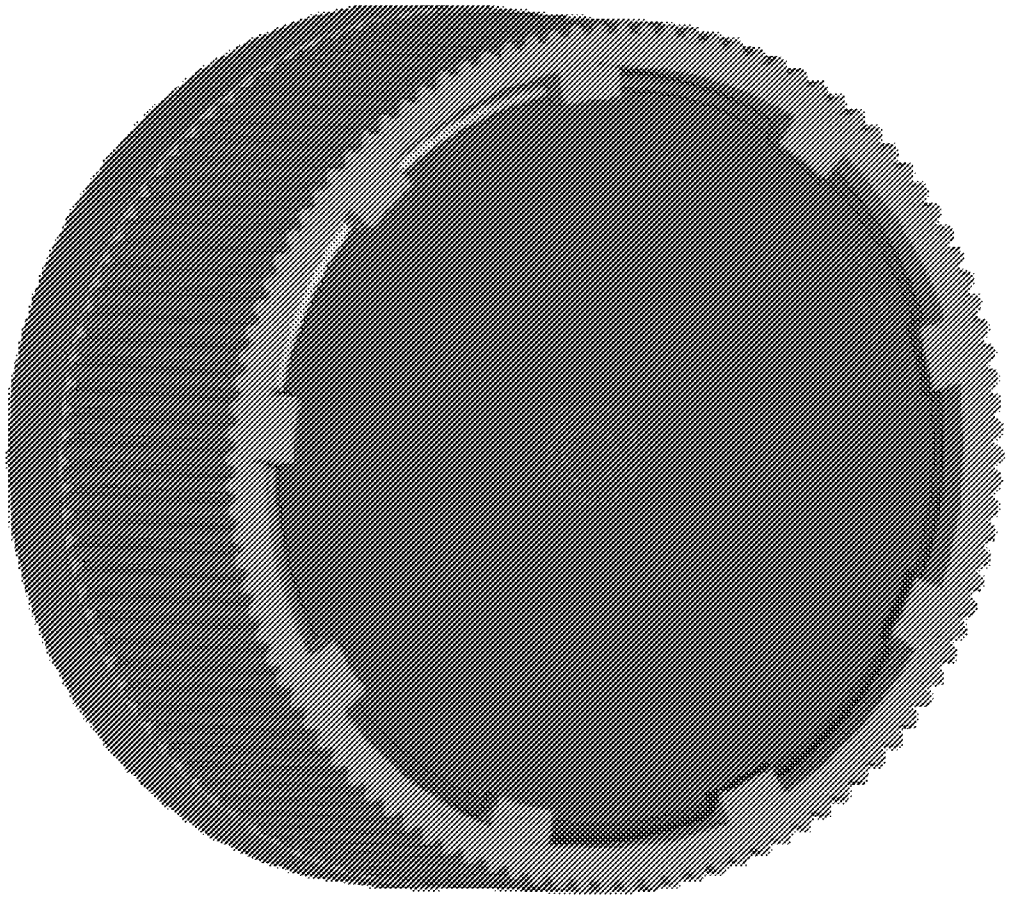
Figure 9B:
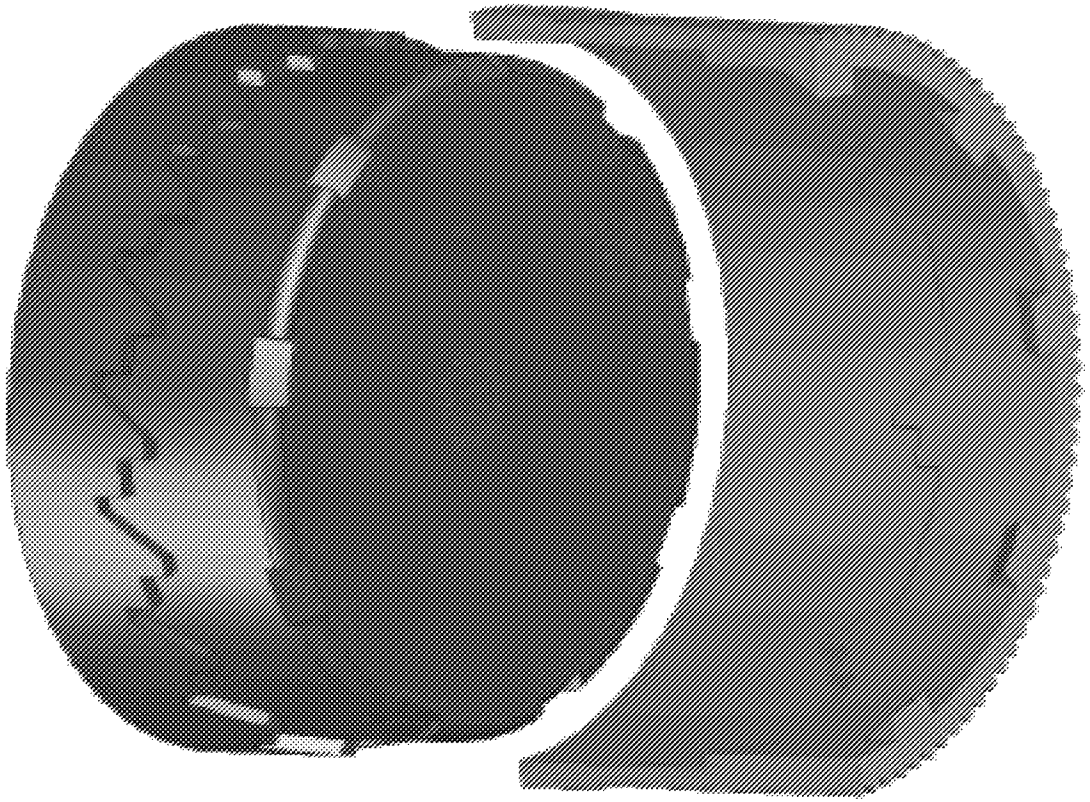
Figure 9C:
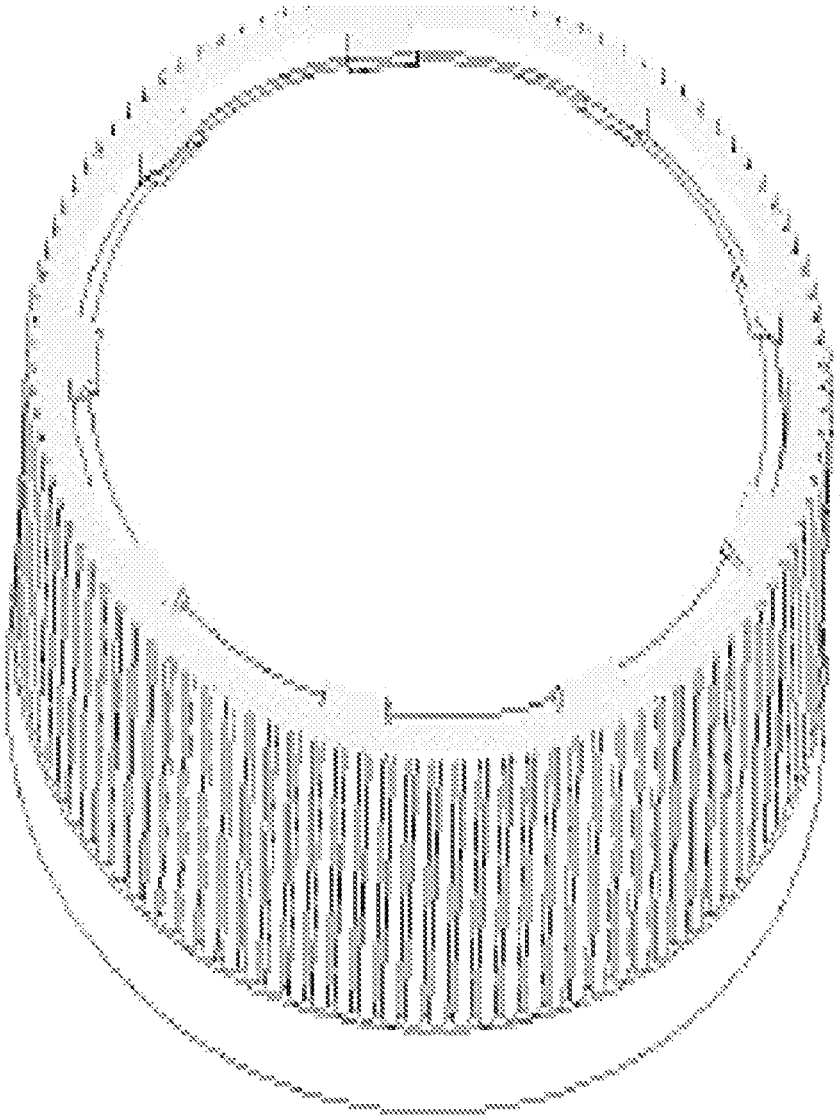
Figure 9D:
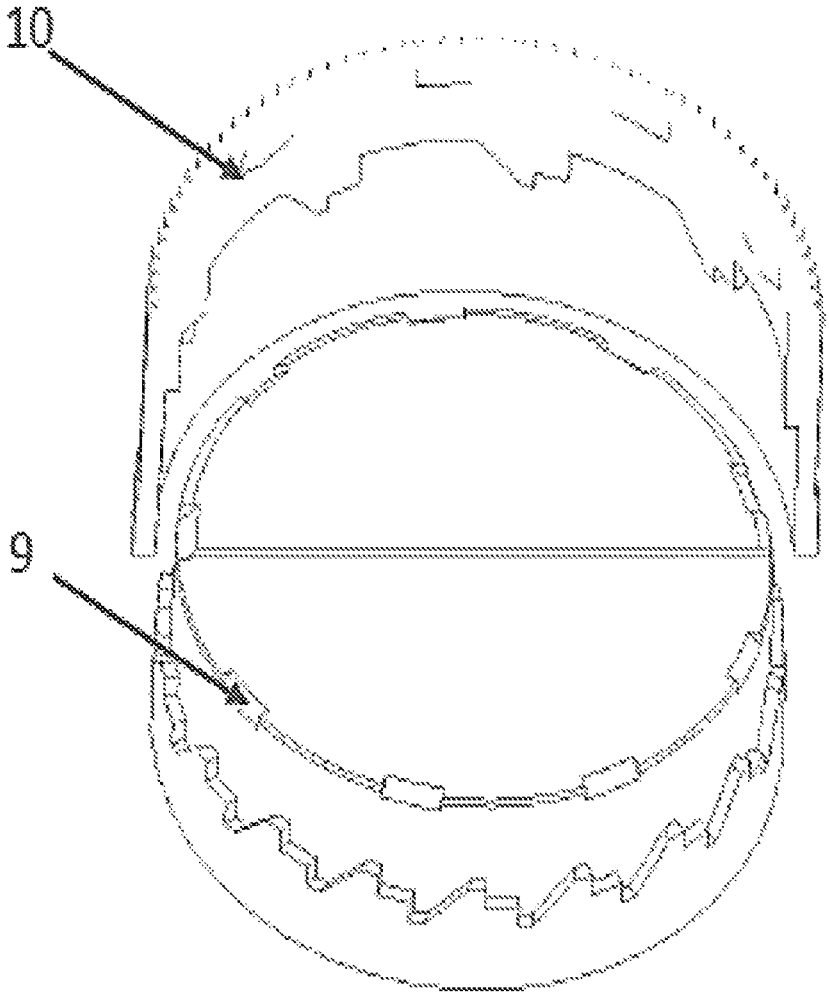

FIG. 8(*a*)-8(*c*) illustrates schematic view of the assembly interaction between the inner cap and outer cap locking ratchet before and after applying pressure, according to one of the embodiments of the present invention.

FIG. 9(*a*)-9(*d*) illustrates schematic view of the locking teeth for locking with the top surface of the inner cap and outer cap, according to one of the embodiments of the present invention.

Persons skilled in the art will appreciate that elements in the figures are illustrated for simplicity and clarity and may not have been drawn to scale. For example, the dimensions of some of the elements in the figure may be exaggerated relative to other elements to help to improve understanding of various exemplary embodiments of the present disclosure. Throughout the drawings, it should be noted that like reference numbers are used to depict the same or similar elements, features, and structures.

DETAILED DESCRIPTION OF THE PRESENT INVENTION

The following description with reference to the accompanying drawings is provided to assist in a comprehensive understanding of various embodiments of the present disclosure as defined by the claims and their equivalents. It includes various specific details to assist in that understanding, but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, a reference to "a component surface" includes a reference to one or more of such surfaces.

All terms (including technical and scientific terms) used herein have the same meaning as commonly understood by one of ordinary skill in the art to which various embodiments belong. Further, the meaning of terms or words used in the specification and the claims should not be limited to the literal or commonly employed sense, but should be construed in accordance with the spirit of the disclosure to most properly describe the present disclosure.

The terminology used herein is for the purpose of describing particular various embodiments only and is not intended to be limiting of various embodiments. As used herein, the singular forms "a," "an" and "the" are intended to include the plural forms as well, unless the context clearly indicates otherwise. It will be further understood that the terms "comprises" and/or "comprising" used herein specify the presence of stated features, integers, steps, operations, members, components, and/or groups thereof, but do not preclude the presence or addition of one or more other features, integers, steps, operations, members, components, and/or groups thereof. Also, expressions such as "at least one of," when preceding a list of elements, modify the entire list of elements and do not modify the individual elements of the list.

The present invention is directed to provide a simple and effective child-resistant closure with twin locking. It focuses on closures openable or removable by the combination of two actions to be performed simultaneously e.g. in this case pushing and turning. The invention discloses the use of a plurality of locking ratchets in the angled and stepped form in both upper and inner cap. Further, it also has an additional provision of locking teeth to provide an additional locking feature to the inner and outer cap of the container.

In the present invention, the inner wall of the outer cap (1) is provided with abutment surfaces i.e. plurality of locking ratchets which are complementary to the locking ratchets of the inner cap (2) as shown in FIGS. 8(*a*)-8(*b*), when the outer cap (1) is rotated in the opposite direction, in the absence of an axial force on the outer cap in the direction of the inner cap, prevents the rotation of the inner cap.

However, by pressing the outer cap (1) downward, the angular protrusion/locking ratchets (3, 4) of the inner surface of the outer cap and locking ratchets (6, 7) provided on the outer surface of the inner cap, meet together at two different locations (3 in outer cap vs. 6 in inner cap & 4 in outer cap vs. 7 in inner cap) as shown in FIG. 8(*c*) and impart rotation to the inner cap (2) for removing the closure from the container. When in this position, additional angular cut/locking teeth as shown in as shown in FIGS. 9(*a*)-9(*d*) provided in the inner cap top surface (9) and angular abutment protrusion provided on the inner top surface of the outer cap (10), gets engaged maintaining sealing of two components to have an additional force to remove the closure from the container.

In one embodiment of the present invention, a child resistant closure with twin locking, comprising a container including a body portion defining a chamber, and a hollow neck extending from said body portion, an inner cap (2) formed to fit around the hollow neck of the container, an outer cap (1) operably disposed over the inner cap (2) adapted to impart an axial rotational force on the inner cap, plurality of locking ratchet (C) positioned on the circumferential inner sidewall surface (D) of the outer cap (1), plurality of locking ratchet (04) positioned on the circumferential outer sidewall surface (02) of the inner cap (2), plurality of locking teeth (E) positioned on the inner top surface (10) of the outer cap (1), plurality of locking teeth (06) positioned on the top surface (9) of the inner cap (2) wherein by pressing the outer cap (1) downward on the inner cap (2), the plurality of locking ratchet (C) positioned on the circumferential inner sidewall surface (D) of the outer cap (1) and the plurality of locking ratchets (04) positioned on the circumferential outer sidewall surface (02) of the inner cap (2) gets engaged with each other to impart rotation to the inner cap (2) in anticlockwise direction to remove the closure from the container and wherein the plurality of locking teeth (E) of the outer cap (1) gets engaged with the plurality of locking teeth (06) of the inner cap maintaining sealing of the outer cap (1) and the inner cap (2) adapted to provide additional force to remove the closure from the container.

In another embodiment of the present invention, the outer cap (1) comprises a plurality of serration (A) on the circumferential outer sidewall surface adapted to enhance the gripping of a user on the outer cap (1).

In another embodiment of the present invention, the outer cap comprises a lock ring (B) on the bottom circumferential periphery of the outer cap (1) adapted to align the outer cap (1) on top of the inner cap (2).

In another embodiment of the present invention, the inner cap (2) comprises a plurality of threads (03) and at least one wad retain ring (05) on the circumferential inner sidewall surface (01) adapted to grip and hold the hollow neck of the container without slipping downwards beyond a predetermined point on the hollow neck of the container.

Yet in another embodiment of the present invention, the locking ratchet (C) positioned on the circumferential inner sidewall surface (D) of the outer cap (1) are complementary to the locking ratchet (04) positioned on the circumferential outer sidewall surface (02) of the inner cap (2).

Those skilled in the art will recognize other use cases, improvements, and modification to the embodiments of the present disclosure. All such improvements and other use-cases are considered within the scope of the concepts disclosed herein.

What is claimed is:

1. A child-resistant closure with twin locking, comprising: a container including a body portion defining a chamber, and a hollow neck extending from said body portion; an inner cap formed to fit around the hollow neck of the container; an outer cap operably disposed over the inner cap adapted to impart an axial rotational force on the inner cap; a plurality of locking ratchet positioned on a circumferential inner sidewall surface of the outer cap; a plurality of locking ratchet positioned on a circumferential outer sidewall surface of the inner cap; a plurality of locking teeth positioned on an inner top surface of the outer cap; a plurality of locking teeth positioned on the top surface of the inner cap; wherein by pressing the outer cap downward on the inner cap, the plurality of locking ratchet positioned on the circumferential inner sidewall surface of the outer cap and the plurality of locking ratchets positioned on the circumferential outer sidewall surface of the inner cap gets engaged with each other to impart rotation to the inner cap in an anticlockwise direction to remove the closure from the container; and wherein the plurality of locking teeth of the outer cap gets engaged with the plurality of locking teeth of the inner cap maintaining sealing of the outer cap and the inner cap adapted to provide additional force to remove the closure from the container; and wherein plurality of locking ratchets positioned on the circumferential outer sidewall surface of the inner cap gets engaged with each other simultaneously to the plurality of locking teeth of the outer cap gets engaged with the plurality of locking teeth of the inner cap.

2. The child-resistant closure as claimed in claim 1, wherein the outer cap comprises a plurality of serration on the circumferential outer sidewall surface adapted to enhance the gripping of a user on the outer cap.

3. The child-resistant closure as claimed in claim 1, wherein the outer cap comprises a lock ring on the bottom circumferential periphery of the outer cap adapted to align the outer cap on top of the inner cap.

4. The child-resistant closure as claimed in claim 1, wherein the plurality of locking ratchet positioned on the circumferential inner sidewall surface of the outer cap are complementary to the plurality of locking ratchet positioned on the circumferential outer sidewall surface of the inner cap.

5. The child-resistant closure as claimed in claim 1, wherein the inner cap comprises a plurality of threads and at least one wad retain ring on the circumferential inner sidewall surface adapted to grip and hold the hollow neck of the container without slipping downwards beyond a predetermined point on the hollow neck of the container.

* * * * *